US010316600B2

(12) United States Patent
Godfrey et al.

(10) Patent No.: US 10,316,600 B2
(45) Date of Patent: Jun. 11, 2019

(54) TUBING HANGER APPARATUS, SYSTEM AND METHODS

(71) Applicant: Peak Completion Technologies, Inc., Midland, TX (US)

(72) Inventors: Matthew M Godfrey, Houston, TX (US); Bryan Fitzhugh, Midland, TX (US); William Sloane Muscroft, Midland, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 175 days.

(21) Appl. No.: 15/610,559

(22) Filed: May 31, 2017

(65) Prior Publication Data

US 2018/0002997 A1 Jan. 4, 2018

Related U.S. Application Data

(60) Provisional application No. 62/343,470, filed on May 31, 2016.

(51) Int. Cl.
*E21B 23/10* (2006.01)
*E21B 33/04* (2006.01)

(52) U.S. Cl.
CPC ..... *E21B 23/10* (2013.01); *E21B 33/04* (2013.01)

(58) Field of Classification Search
CPC ..... E21B 23/10; E21B 33/04
See application file for complete search history.

(56) References Cited

U.S. PATENT DOCUMENTS 3,223,170 A * 12/1965 Mott ..... E21B 23/04 166/153

* cited by examiner

*Primary Examiner* — Wei Wang

(57) ABSTRACT

Hangers and related tools which actuate without fluid or mechanical communication between the interior of the tool and its exterior are disclosed. Devices as disclosed herein may include a piston for applying actuating force based on the fluid pressure outside of the tool. The piston may be fixed to a tubing wall or other body of the tool with a shear element to prevent the tool from actuating until a certain pressure is applied to piston, such as by the static pressure of wellbore fluid at a certain depth, by pressure applied to the annulus from surface, or a combination thereof. Actuation of the tool may cause latches to expand outwardly to engage a latch receptacle fixed in or along the host tubing or such actuation may lead to other hanging members, such as slips, to engage the host tubing wall in order to suspend the hanging string therein.

12 Claims, 8 Drawing Sheets

TUBING HANGER APPARATUS, SYSTEM AND METHODS

CROSS REFERENCE TO RELATED APPLICATIONS

This application claims the benefit of U.S. Provisional Patent Application Ser. No. 62/343,470 titled "Tubular Connector Device and Methods", filed on May 31, 2016, the entirety of which is incorporated herein by reference.

STATEMENT REGARDING FEDERALLY SPONSORED RESEARCH OR DEVELOPMENT

Not applicable.

BACKGROUND

The present disclosure relates to apparatuses, systems and methods for suspending tubing in a well or wellbore. Certain embodiments according to the present disclosure may permit actuation of the apparatus without applying fluid pressure or fluid flow, may permit systems or apparatuses to operate without teeth or other elements that bite into the casing wall, may set automatically upon reaching the desired location, combinations of certain or all of the foregoing, and/or provide other benefits.

Devices for suspending tubing, such as a tubing string, within sections of a well or wellbore are known in the art. Such devices utilize slips with teeth, buttons, or other features to penetrate the wall of the wellbore, which may be larger diameter tubing (host tubing), surrounding the device. Longitudinal force may be applied in order to move the slips up a cone or other angular surface to force the slips radially outward and create such penetration. Such devices may be identified as liner hangers, liner top packers, permanent packers, or other nomenclature, and are intended to be part of a sealed fluid flowpath from the surface, or other selected location, down to lower regions of the well.

Actuation of many such prior art devices requires communication of force, such as fluid pressure, from the interior of the device in order to generate longitudinal movement of the slips, or of the cone in relation to the slips, on the outside of the device. In other words, the walls of such devices have ports, slots, or other penetrations to allow communication of setting forces. The penetrations are typically in fluid isolation from the device's interior flowpath and/or exterior through the use of o-rings or other sealing elements. Seals may fail, however, compromising the fluid integrity of the interior flowpath and in some cases preventing the proper function of the devices. Prior art devices also comprise slips that penetrate into, causing at least some damage to, the wall of tubing into which the device is suspended.

Further, prior art devices require a separate running tool so that the slips and other components may be reliably set at the desired time and in the desired order. The need for such running tools requires a trip out to remove the setting tool and an additional run into the well to connect treating or production tubing with the hanger string. Eliminating the need for such running tools, may be simplify and speed up installation, thereby reducing costs.

BRIEF SUMMARY

Embodiments of the present disclosure include hanger devices which do not have penetrations through the device wall because such devices do not require communication of force, such as fluid pressure or mechanical force, through the wall of the device in order to actuate. Embodiments according to the disclosure herein may actuate and set based in part on the distance below surface and/or location of the hanger within the host tubing. Still further embodiments may eliminate the use of teeth or other devices that penetrate the wall of the tubing into which the device is set.

Certain embodiments of the present disclosure may comprise a collet with latches that, in the actuated or set state, engage both a hanging shoulder fixed to the hanger string (the string to be placed and hung off within the host string) and a receiving or engagement shoulder fixed to or along the host string. In some embodiments, the hanging shoulder may have a diameter that will pass through the receiving shoulder in the absence of the latches.

Embodiments of the present disclosure may be installed in the host tubing without the use of a running tool which must be removed from the well. Conventional tubing connections at the top of the hangers may be used to connect the hanger in a string extending to the surface. Such connections may be threaded or other types of connections.

Embodiment devices may further comprise an actuating assembly to provide force for moving the hanging elements outward, such as over the angular shoulder of cone and into engagement with the host tubing at, or after, a selected point in the well. Some actuating assemblies may include a piston to push the hanging elements up a cone based on the pressure of the fluid surrounding the piston. Shear pins may be used to hold the piston in its initial position until the surrounding fluid pressure applies sufficient force to the piston to overcome the shear value of the pins. Shear values may be selected with consideration for wellbore fluid density and piston surface area so that the piston will not apply force to actuate the tool until the tool reaches a certain depth or until external pressure is added to the annulus between the host string and the hanging string.

Embodiments according to the present disclosure may further a coupling for placement along the host tubing string. Such coupling may have a latch receptacle section coordinated with embodiment hangers according to the disclosure herein such that positioning of the latches adjacent to the coupling allows the hanger to fully set and the latches to engage with the coupling, suspending the hanger string in the host string.

DETAILED DESCRIPTION

Figure 1A:
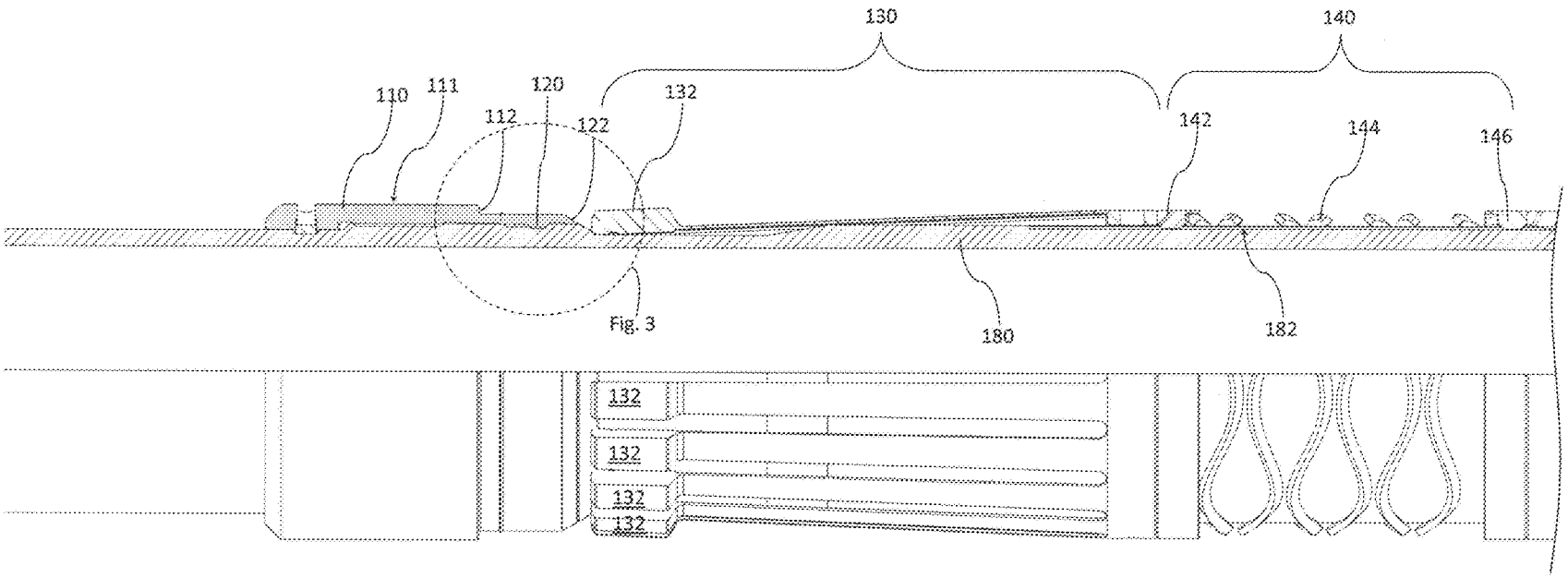
FIGS. 1A and 1B are a sectional elevation of an embodiment hanger according to the present disclosure.
Figure 1B:
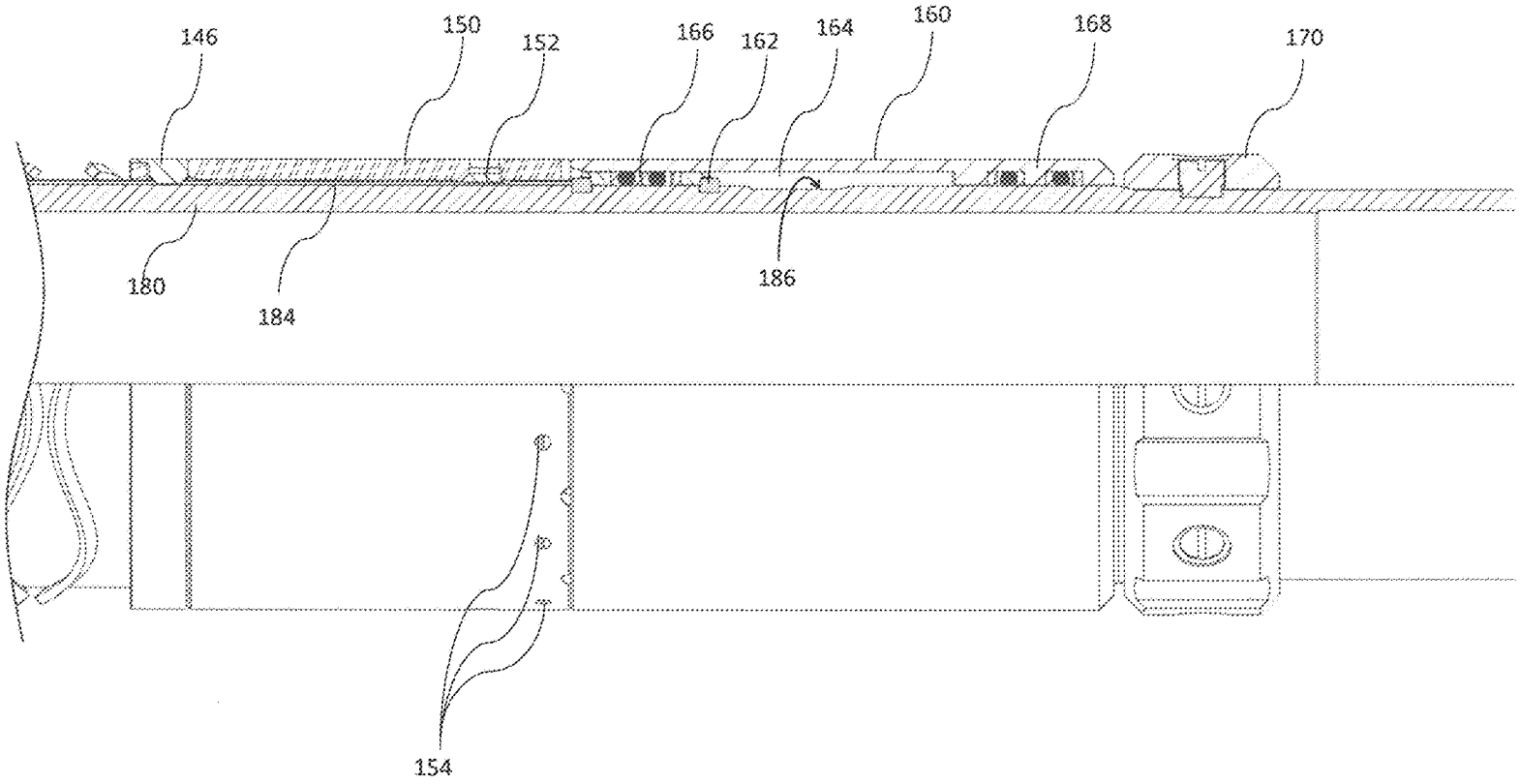

FIGS. 1A and 1B illustrate one embodiment according to the present disclosure in the unactuated or run in position. The illustrated embodiment comprises tubing 180 with a hanging section and an actuation section arranged on its outer surface. The hanging section comprises a top sub 110, the top sub 110 having a hanging shoulder 112, cone 120 with angular surface 122 and collet 130 having a plurality of latches 132 positioned adjacent to angular surface 122.

The actuation section may comprise a spring element 140, a piston 160 and a lock such as lock ring 152 in lock housing 150. Spring assembly 140 may be adjacent to and engage collet 130. Spring assembly 140 may comprise a spring element 144 and end rings 142, 146. End rings 142, 146 may be attached to the ends of spring element 144 and may engage a groove 182, such as in tubing 180, such that spring assembly 140 resists rotation.

Piston 160 slidably engages tubing 180. Seal stacks 166, 168 prevent fluid communication between the piston 160 and the tubing 180 and define chamber 164. Chamber 164 has a fluid pressure therein which may be determined during assembly of the tool. Certain embodiment tools may have a valve or other device to permit adjustment of the fluid content or fluid pressure of chamber 164 after assembly. Lock housing 150 slidably engages tubing 180 and contacts piston 160 adjacent to seal stack 166. Lock housing 150 may be connected to tubing 180 by shear pins 154 to prevent premature movement of lock housing 150 and piston 160. Lock ring 152 is in a groove in lock housing 150 such that movement of lock housing 150 moves lock ring 152 therewith.

Gauge ring 170 is connected to tubing 180 adjacent to piston 160. The outer diameter of gauge ring 170 is greater than the outer diameter of collet 130, end rings 142, 146, spring 144, lock housing 150 and piston 160. Top sub 110 has outer diameter 111 similar to the outer diameter of gauge ring 170. Configured as described, top sub 110 and gauge ring 170 may reduce the contact between the moveable components—collet 130, spring assembly 140, lock housing 150 and piston 160—and the inner wall of tubing, including the host tubing, through which the tool is being conveyed.

Figure 2A:
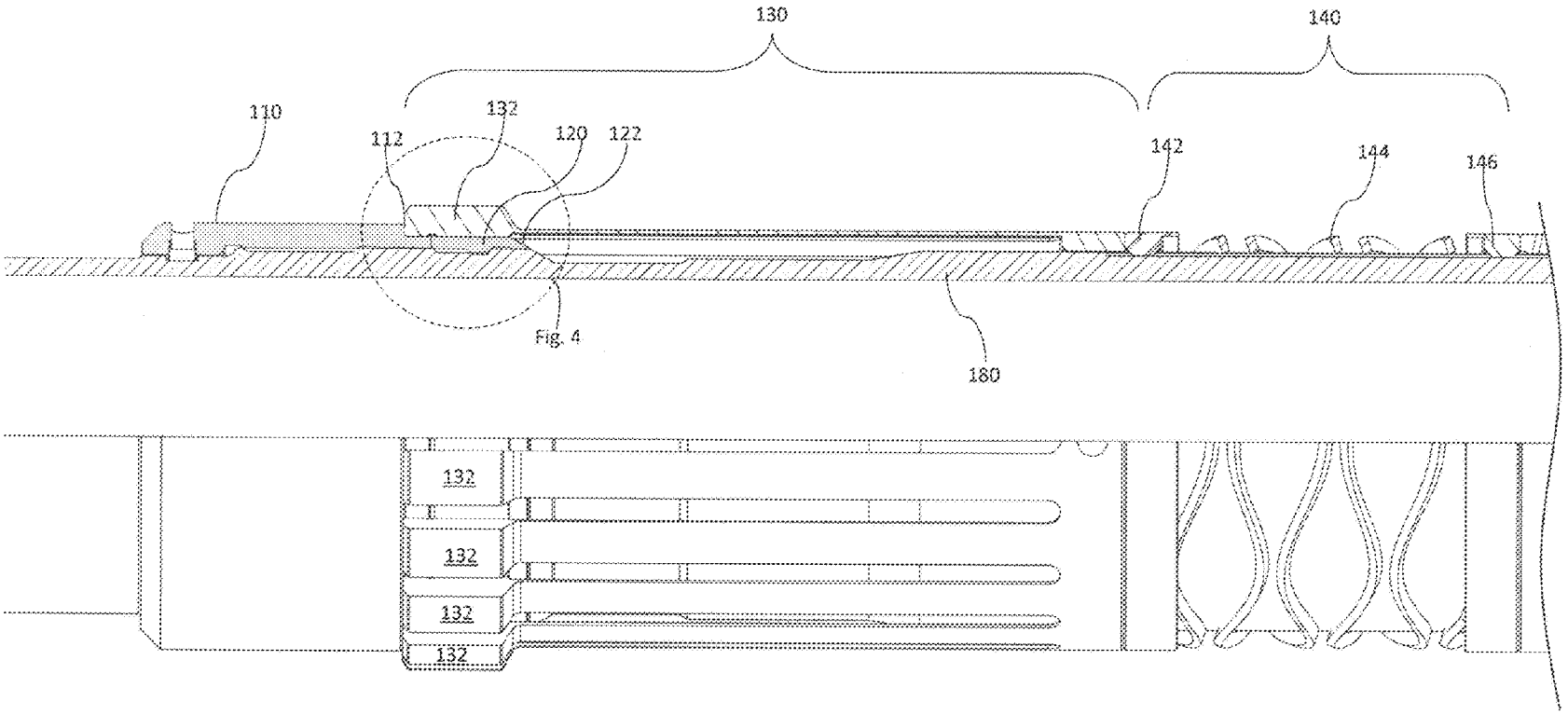
FIGS. 2A and 2B are a sectional elevation of an embodiment hanger according to the present disclosure in a set position.
Figure 2B:
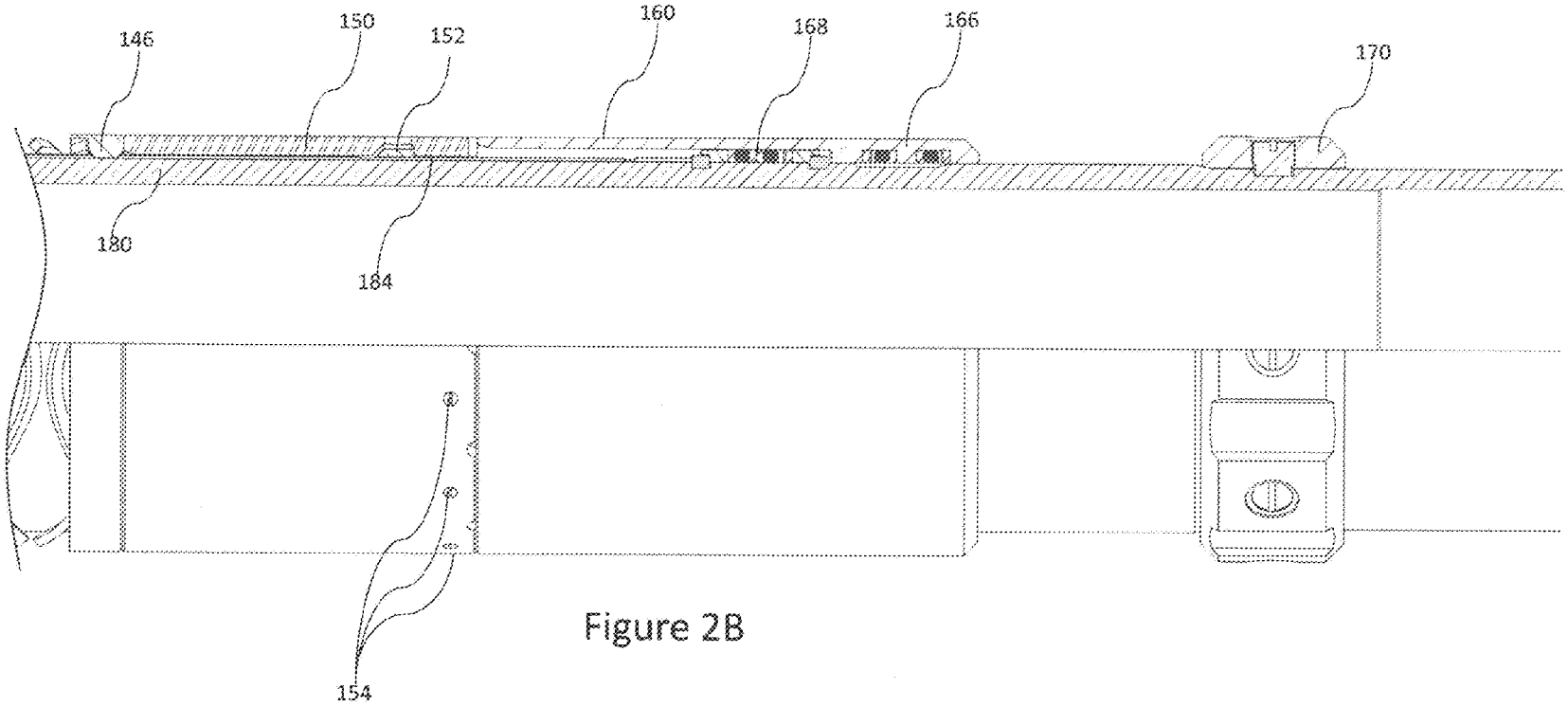

FIGS. 2A and 2B show an embodiment tool in the actuated state. In the embodiment of FIGS. 2A and 2B, piston 160 has moved such that seals 166 have moved towards stop 162, reducing the size of chamber 164. Such movement may occur in response to hydrostatic pressure against the end of piston 160 near seal stack 166 creating a pressure differential in comparison to the fluid in chamber 164. When the force from the pressure differential becomes sufficiently high, shear pins 154 break, permitting movement of piston 160 and lock housing 150.

As will be appreciated, movement of the lock housing 150 will compress spring 144 of spring assembly 140, applying longitudinal force to collet 130 through end ring 142. Collet 130 may then slide along the outer surface of tubing 180, forcing latches 132 outward along the angular surface 122 of cone 120. Lock ring 152 engages teeth 184 along the outer surface of tubing 180, holding the lock housing 150 in its actuated position and maintaining the actuation force on spring 144.

In this arrangement, it will be appreciated that spring 144 may act as a load dampener, compressing and thereby absorbing some of the force otherwise applied to collet 130 from piston 160. The actuation section may have additional features to dampen or otherwise limit the load applied to the collet 130. For example, the actuation section may have a stop, such as ring 162, which in the illustrated embodiment also serves to hold seal stack 166 in place. Further, tubing 180 may have a depression 186 such that movement of seal stack 168 over depression 186 establishes fluid communication from the exterior into chamber 164, thereby eliminating the pressure differential across piston 160. This alleviates the hydraulic force driving piston 160. Force to set, and hold, latches 132 onto cone 120 and top sub 110 may be maintained by the lock housing 150—retained by engagement of lock ring 152 on teeth 184—holding spring 144 in compression between collet 130 and lock housing 150.

Tubing 180, may be threaded at either end for connection of the hanger to the hanger string. Other connections to tubing 180 may also be used. The hanging string, which extends to the surface, may remain in place after the latches are set against the hanging shoulder because there is no requirement to trip out of the well to remove a setting tool. In other words, for tripping purposes, tubing 180 acts like any other joint of tubing in the hanging string.

Figure 3:
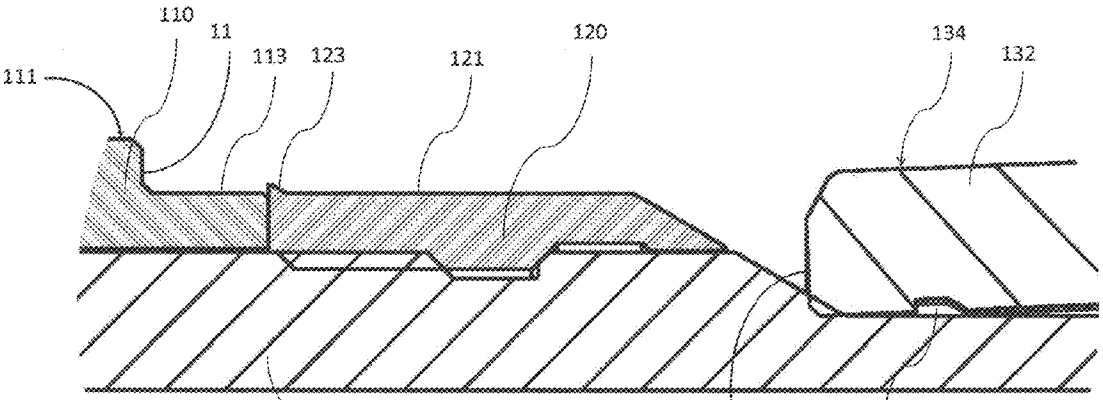
FIG. 3 is a partial sectional elevation of the hanger in FIGS. 1A and 1B more fully disclosing the region adjacent the latch section of the collet, the top sub, and the cone.
Figure 4:
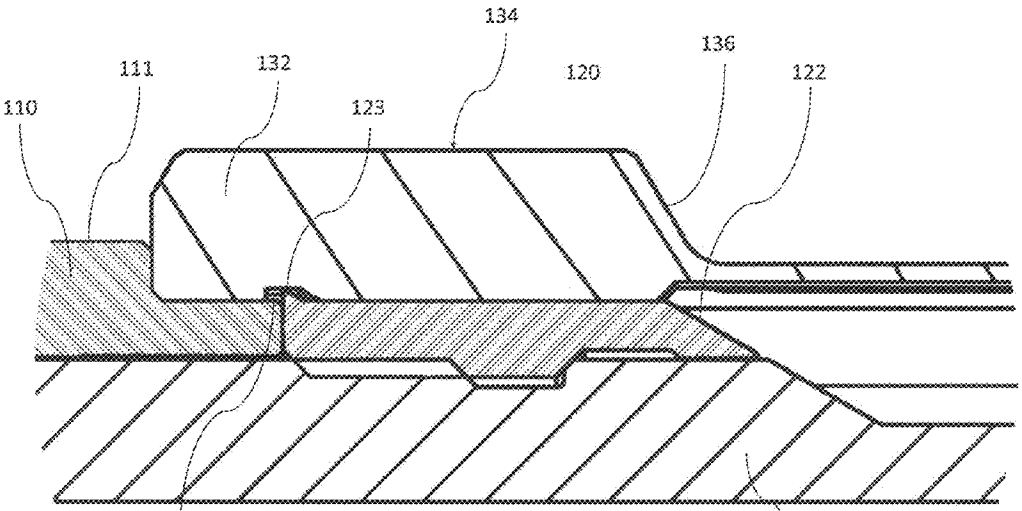
FIG. 4 is a partial sectional elevation of the hanger in FIGS. 2A and 2B more fully disclosing the region adjacent the latch section of the collet, the top sub, and the cone with the hanger in a set position.

FIGS. 3 and 4 are enlarged views of a portion of the latching section as indicated in FIGS. 1A and 2A respectively and showing the relationship of the latches 132, cone 120, top sub 110, and tubing 180 of certain embodiments according to the disclosure herein. In the run-in or non-actuated position, as can be seen in FIG. 3, the outer surface 134 of latches 132 is radially inward of the largest diameter surface 111 of top sub 110. Following actuation, as can be seen in FIG. 4, the force from the spring 144 forces latches 132 upward across angular surface 122 of cone 120 and onto the outer surface 121 of cone 120 and receiving surface 113 of top sub 110. It will be appreciated that, in the embodiment of FIG. 4, top sub 110 functions as a hanging sub for transferring the weight of the hanging string through the latch and into the host string. The hanging sub may be the topmost element around tubing 180, but locating a hanging sub as the topmost element is not required. Such movement of latches 132 causes a portion of upper face 138 of latches 132 to engage shoulder 112 of top sub 110. Further, in the actuated position, outer surface 134 of latches 132 has a greater radius (is a greater distance) from the center of tubing 180 than the outer diameter 111 of top sub 110.

Latches 132 may have a groove 133 engageable by a shear ring, such as shear ring 123 of cone 120. Such shear ring 123 may help maintain latch 132 in the set position while having a shear value that permits removal of the hanging device, including tubing 180, in response to force that exceeds the capacity of the shear ring 123.

Figure 5:
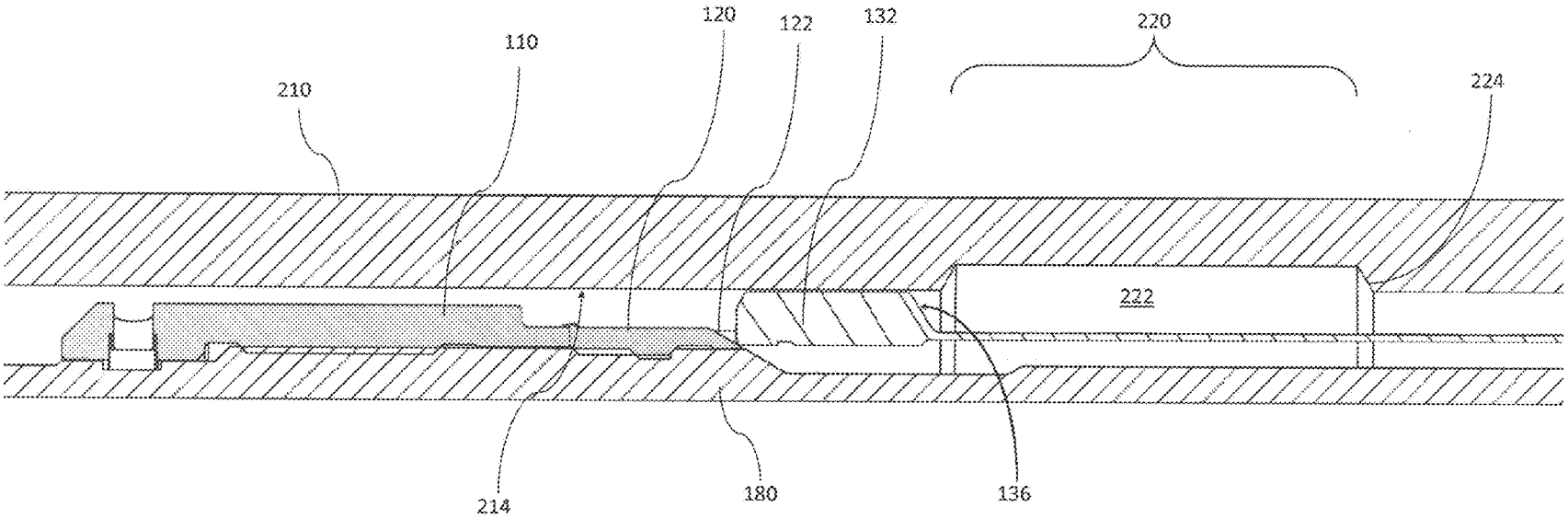
FIG. 5 is a partial sectional elevation of an embodiment hanger showing the latch section of the collet inside a section of a host string.

FIG. 5 shows an embodiment tool in an actuated and unset position. Piston 160 has moved to the actuated position, such as described with respect to FIG. 2B for example, compressing spring 144, applying longitudinal force to collet 130 and causing latches 132 to move radially outward along angular surface 122. The ability of latches 132 move outward may be limited, such as by contact between outer surface 134 of latch 132 and the inner surface 214 of host tubing 210. It will be appreciated that host tubing 210 may be casing, liner or any other tubing. Outer surface 134 of latch 132 may be hardened to reduce the wear to latch 132 as it moves along the inner surface 214 of host tubing 210.

As the collet 130 moves down the tubing 210, latches 132 may be brought adjacent to a latch receptacle having an engagement portion 220. The engagement portion 220 is configured, both in depth and length, to permit latches 132 to complete its movement radially outward along angular surface 122 and to engage bottom sub 110 at hanging shoulder 112. Thus, in the illustrated embodiment, moving the latches 132 adjacent to the engagement portion 220 permits the latches 132 to move to the fully set position, such as is shown in FIG. 2A. In this way, latches 132 may function as a locator to identify the designated location for setting the hanger in the well.

Figure 6:
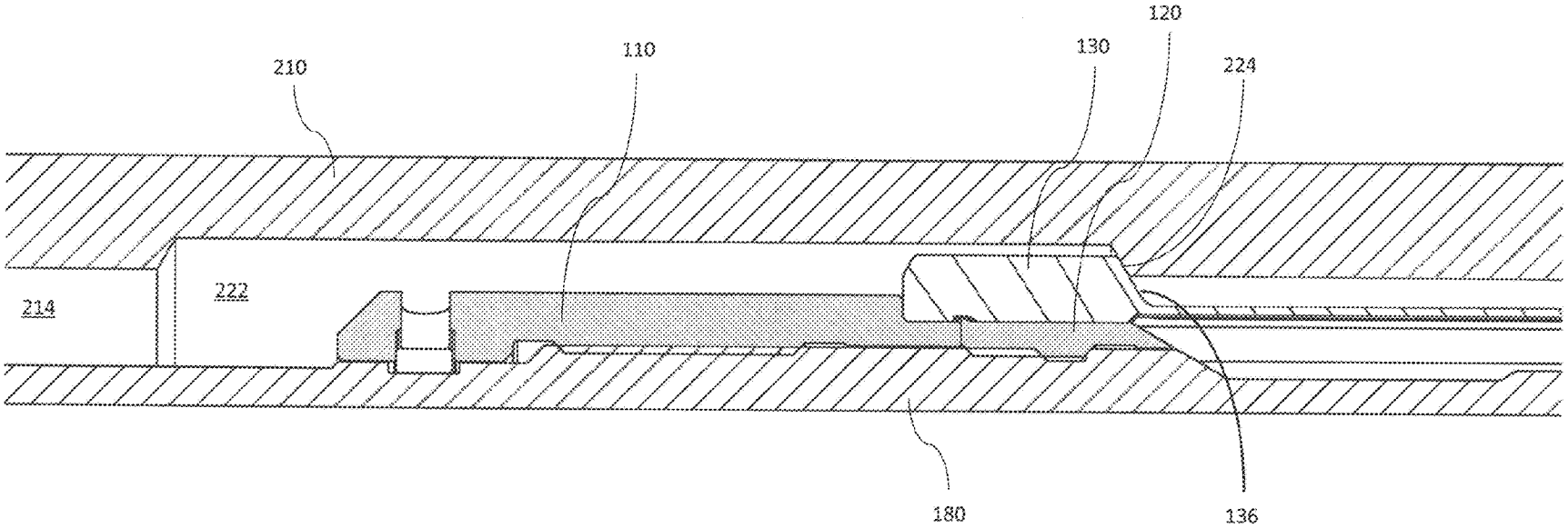
FIG. 6 is a partial sectional elevation of an embodiment hanger showing the latch section of the collet inside the engagement portion along a host string.

After the collet 130, and therefore latches 132, move to the set position, the latches 132 may be brought into contact with the engagement shoulder 224 adjacent to engagement portion 220 of the latch receptacle such as is shown in FIG. 6. Latches 132 are positioned between and engaging each of the hanging shoulder 112 and engagement shoulder 224. In this way, the weight of the hanging string is transferred to latch 132 through hanging shoulder 112 and from latch 132 to the host tubing 210 through engagement shoulder 224. It will be appreciated that the diameter of engagement portion's inner surface 222 may be configured to engage the outer surface 134 of latches 132, preventing latch 132 from disengaging hanging shoulder 112. Further, the outer surface of cone 120, and the outer surface of top sub between cone 120 and hanging shoulder 112 prevent latches 132 from disengaging with engagement shoulder 224. Latch 132 may thereby be mechanically trapped between four or more surfaces. In some embodiments, leading edge 136 may be configured such that the weight of tubing 180 pulls latch 132 radially inward as leading edge 136 of latches 132 seats on engagement shoulder 224.

It will be appreciated that the latch 132 and top sub 110 are the only portions of the hanger assembly that bear any substantial portion of the load from the hanger string. Thus, top sub 110 is configured such that its connection to the tubing 180, e.g. a threaded connection, and the hanging shoulder 112 are sufficient to bear the weight of the hanger string along which the hanger is placed. The weight of such hanger string imposes shear and bearing forces on latches 132 and collet 130 may be designed and manufactured to withstand such shear and bearing forces. However, the fingers of collet 130 generally do not bear any such load. In some embodiments, it may be possible to include latches 132 of one material and attach them to a collet of another, weaker material because in such embodiments the fingers may only function to connect the piston 160 to latches 132 and to push the latches 132 up the angular surface 122 cone 120 when the piston 160 is actuated.

The embodiment of FIG. 1A is shown as having a collet 130 with latches 132 having a smaller outer radius in the relaxed state than in the set state illustrated in FIG. 2A. Embodiments having a collet with latches 132 at a larger radius in the relaxed state than in the set state are also within the scope of the present disclosure. In some wells, host tubing 210 may extend from the well surface in a single diameter to the engagement section 220. In such wells, retracting the collet 130 for insertion into the well may permit the inner surface 214 of the host tubing 210 to hold the latches in an actuated but unset position until the latches 132 are positioned adjacent to the engagement portion 220. A retracting ring, for example, may be placed around the collet fingers and/or latches 132 to hold the latches in a retracted position. Such ring may be configured to be removable from around the latches 132 as the latches 132 are moving inside the host tubing 210. Such embodiments would not require an actuation section but may still require a spring or other mechanism applying force to move the latches 132 up angular surface 122 and into engagement with top sub 110.

The latches may be configured such that the length of upper surface 134 prevents presetting of the latches. In some embodiments, the latches may be about 1.5 inches to about 1.75 inches, though other sizes are within the scope of the present disclosure. Casing strings, which serves as host tubing 210 in some embodiments, may have incompletely made up connections or other irregularities along the inner surface 214. If outer surface 134 is of sufficient length, latch 132 cannot expand out into such irregularities. Further, a leading profile 136 of latch 132 having an obtuse angle relative to the hanging strings line of travel may assist in guiding latch 132 out of such irregularities and prevent presets or other failures.

It will be appreciated that alternative embodiments may include hanging sections with slips or other load bearing element in place of the latch. In such a case, collet fingers may function as the locator, preventing setting of the load bearing element until the desired location is reached. Further, the collet of the present disclosure may be combined with alternative actuation mechanisms. For example, radio frequency identification (RFID) or magnetic induction may be used to release a compressed spring engaging the collet to push latch onto the top sub. Alternatively, RFID or magnetic induction could be used to release the piston to move in response to the wellbore hydraulic pressure or to release fluid and create a pressure differential across the piston.

Figure 7:
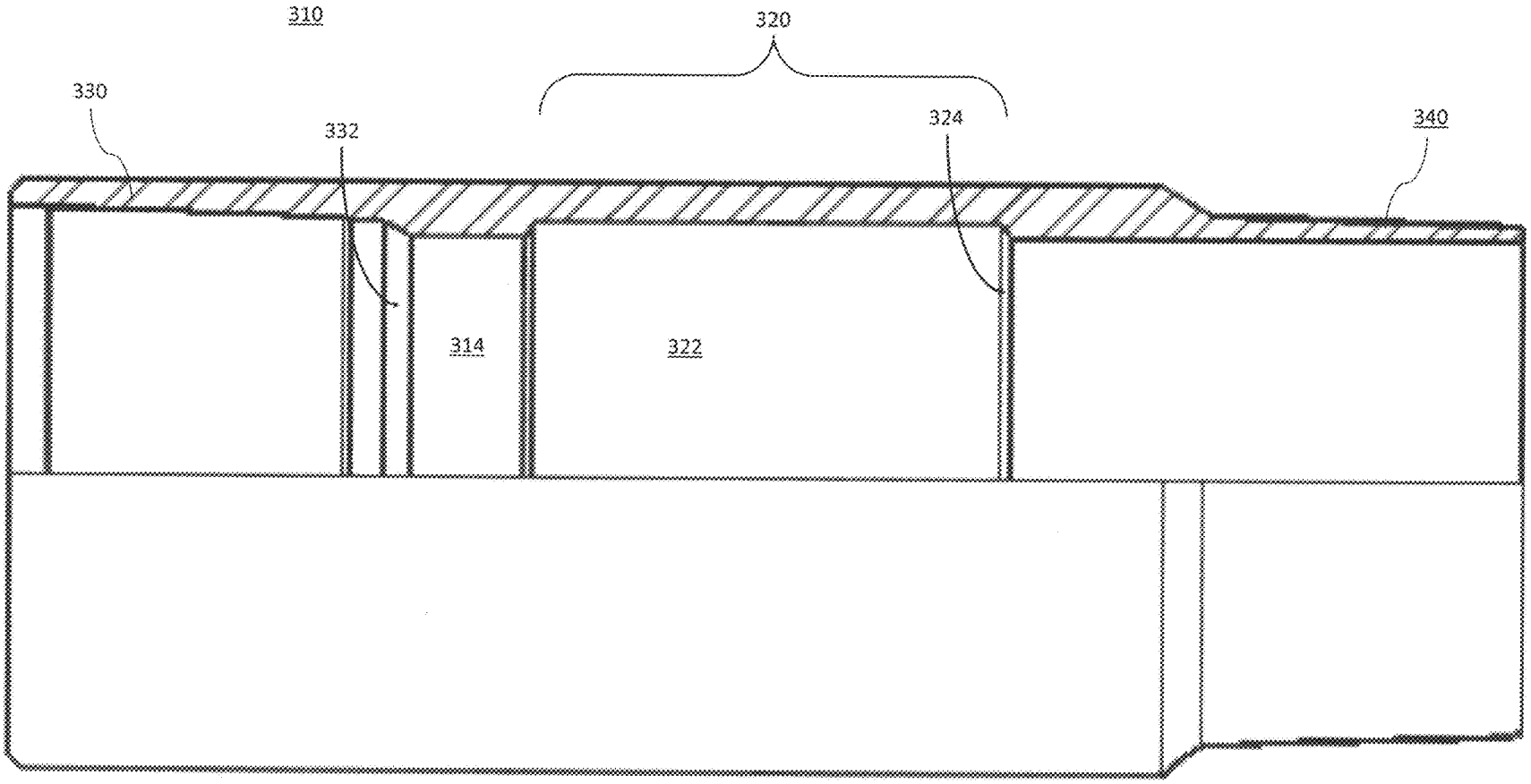
FIG. 7 is a sectional elevation of one embodiment coupling for connecting adjacent tubing of a host string.

FIG. 7 shows an embodiment tubing coupling 310 which may be used as a latch receptacle with certain embodiment hangers according to the disclosure herein. The illustrated embodiment of FIG. 7 is a box to pin coupling, and other coupling arrangements, including without limitation box-to-box, pin-to-box, and pin-to-pin couplings are within the scope of the present disclosure. The embodiment coupling 310 has a box end 330, a box shoulder 332, a pin end 340, an inner surface 314, an engagement portion 322 and an engagement shoulder 324. Box end 330 and pin end 340 may be threaded to connect with tubing on either end of the coupling 310, thereby incorporating couple 310 into a tubing string. Box end 330 will connect to a pin end of adjacent tubing, bringing the inner wall of such tubing adjacent to inner surface 314. Such inner wall may have a diameter similar or substantially identical to inner surface 314 and the end of such pin may engage or otherwise shield box shoulder 332 to prevent collet latches 132 from engaging the connection and hanging up in the tubing string.

Engagement portion 320 is configured similarly to engagement portion 220 in FIGS. 5 and 6 to permit collet latches 132 to expand along cone 120 to engage the shoulder 112 of top sub 110. Further movement of the hanger toward the pin end 340 of coupling 310 brings latches 132 against engagement shoulder 324, setting the hanger in place against and preventing further movement toward the pin end 340. It will be appreciated that the embodiment of FIG. 7 may be placed in the host string with pin end 340 down relative to the box end 330 such that gravity applies force pulling collet latches 132 onto engagement shoulder 324 and pulling shoulder 112 of top sub 110 onto the upper ends of collet latches 132. In this way, gravity fixes top sub 110, and attached hanging string, to coupling 310, thereby securing the hanging string in the host string.

Other Devices according to the present disclosure are described with reference to one or more specific embodiments. For example, "dogs" or "lugs" may be used in place of the collet fingers and serve as the latch. Such dogs or lugs may be spring loaded to assist in either their outward movement, such as by loading onto a cone or otherwise, or resisting movement of the dogs or lugs outward until the actuating device, whether hydraulic, magnetic, RFID or other, is triggered. Host string devices other than couplings, such as specialized tubing joints, may be used to engage the hanger latches. In some embodiments, a separate device may be installed inside the host string prior to running the hanging string to create an engagement shoulder or similar structure to receive the collet latches. Embodiment devices may include devices according to Applicant's U.S. patent application Ser. No. 14/844,192, entitled Shortened Tubing Baffle with Large Sealable Bore, filed on Sep. 3, 2015, which is incorporated herein in its entirety by reference. The slips of such devices may be used to engage a host string while the enlarged section of the mandrel at the upper end of such baffles may be used as an engagement shoulder for receiver the collet latches. Alternative embodiments which may be shortened by removal of the elastomeric elements are also with the scope for installation with the host string. Further alternatives to the described arrangements will be apparent from a review of the embodiments of the disclosure and such alternatives are within the scope of the invention as claimed.

We claim:

1. A downhole tool for installing a hanging string in a host tubing string, the host tubing string having a latch receptacle, the downhole tool comprising:

a tubular member having a wall, an interior and an exterior;

a collet comprising collet fingers with a plurality of latches attached thereto and surrounding the tubular member, the plurality of latches in fluid and mechanical isolation from the interior of the tubular member;

a hanging sub connected to the tubular member and having a hanging shoulder; and a cone having an angular surface, said angular surface between the latches and the hanging shoulder;

wherein, positioning the plurality of latches adjacent to the latch receptacle permits the latches to move up the angular surface and engage the hanging shoulder; and engagement of the plurality of latches with the hanging shoulder and with an engagement shoulder of the latch receptacle communicates the downward force of the hanging string to the latch receptacle, suspending the hanging string in the host tubing string.

2. The downhole tool of claim 1 further comprising a spring engaged with the collet, the spring configured to apply force for pushing the plurality of latches up the cone and into engagement with the hanging shoulder.

3. The downhole tool of claim 1 further comprising a piston surrounding the tubular and in communication with the plurality of latches, wherein fluid pressure applied the piston exerts force pushing the plurality of latches up the angular surface and into engagement with the hanging shoulder.

4. The downhole tool of claim 3 wherein the piston comprises at least one shear pin preventing the piston from applying force to the collet until the fluid pressure is sufficient to break the at least one shear pin.

5. The downhole tool of claim 1 further comprising a gauge ring having an outer diameter, wherein the outer surfaces of the latches are interior to the gauge ring's outer diameter when the collet is in a relaxed position.

6. The downhole tool of claim 1 further comprising a spring assembly engaging the collet, the spring assembly comprising a spring and at least one anti-rotation element, wherein the spring applies force to the collet for moving the downhole tool to a set state.

7. A downhole tool for suspending a tubing string inside a host string, the downhole tool comprising:

a tubular member having a wall, an interior and an exterior;

a piston having an exterior surface, an interior chamber; an angular surface; and a plurality of hanger members between the piston and the angular surface;

wherein, the interior of the tubular member is isolated from the exterior;

fluid pressure in the host string applies force to the piston to move the hanging members up the angular surface; and engagement of the hanging members with the host string suspends the tubing string in the host string.

8. The downhole tool of claim 7 wherein the piston further comprises a plurality of shear pins, the shear pins preventing the piston from moving the hanger members up the angular surface until the fluid pressure applies sufficient force to the piston to break the shear pins.

9. The downhole tool of claim 8 further comprising a spring assembly between the piston and the hanging members, wherein the spring dampens the force applied by the piston as it shifts in response to fluid pressure in the host string.

10. The downhole tool of claim 7 further comprising a spring assembly between the piston and the hanging members, wherein the spring assembly is compressed by movement of the piston and transfers force form the piston to move the hanging members up the angular surface.

11. The downhole tool of claim 10 further comprising an upper gauge ring above the angular surface and a lower gauge ring below the piston, the gauge rings each having an outer diameter greater than the outer diameters of the piston, angular surface, hanging members, and spring assembly.

12. The downhole tool of claim 7 wherein the hanging members comprise a plurality of latches and the host string comprises a latch receptacle.

* * * * *